US006253469B1

(12) United States Patent
Atlani et al.

(10) Patent No.: US 6,253,469 B1
(45) Date of Patent: Jul. 3, 2001

(54) RELAXATION SOLE AND SHOE EQUIPPED THEREWITH

(76) Inventors: Catherine Atlani, 30 Passage Thiéré; Alain Jouenne, 11, Rue Daval, both of 75011 Paris (FR)

( * ) Notice: Subject to any disclaimer, the term of this patent is extended or adjusted under 35 U.S.C. 154(b) by 0 days.

(21) Appl. No.: 09/462,568

(22) PCT Filed: Jul. 10, 1998

(86) PCT No.: PCT/FR98/01507

§ 371 Date: Feb. 25, 2000

§ 102(e) Date: Feb. 25, 2000

(87) PCT Pub. No.: WO99/02058

PCT Pub. Date: Jan. 21, 1999

(30) Foreign Application Priority Data

Jul. 11, 1997 (FR) ..... 97 08869

(51) Int. Cl.[7] ..... A43B 13/38; A61F 5/14

(52) U.S. Cl. ..... 36/174; 36/173; 36/140; 36/43

(58) Field of Search ..... 36/174, 142, 143, 36/144, 140, 173, 88, 43, 44, 92

(56) References Cited

U.S. PATENT DOCUMENTS

| | | | | |
|---|---|---|---|---|
| 1,973,402 | * | 9/1934 | Bohmbach | 36/173 |
| 1,976,441 | * | 10/1934 | Feldman | 36/173 |
| 2,081,474 | * | 5/1937 | Burns | 36/173 |
| 2,421,088 | * | 5/1947 | Sims . | |
| 2,546,408 | | 3/1951 | Riggs . | |
| 2,943,405 | * | 7/1960 | Olson et al. | 36/173 |
| 4,841,648 | * | 6/1989 | Shaffer et al. | 36/43 |
| 4,928,404 | * | 5/1990 | Scheuermann | 36/71 |
| 4,955,148 | | 9/1990 | Padilla . | |
| 5,014,706 | | 5/1991 | Philipp . | |
| 5,625,965 | * | 5/1997 | Blissett et al. | 36/43 |

FOREIGN PATENT DOCUMENTS

| | | |
|---|---|---|
| 33 06 425 A1 | 8/1984 | (DE) . |
| 35 04 363 A1 | 8/1986 | (DE) . |
| 2 676 918 | 12/1992 | (FR) . |

* cited by examiner

*Primary Examiner*—M. D. Patterson
(74) *Attorney, Agent, or Firm*—Oliff & Berridge, PLC

(57) ABSTRACT

A relaxation insole having, in combination:

a supination-providing heel cup;

a heel-bone support;

a support beneath the first two metatarsals; and a support beneath the last three metatarsal heads.

9 Claims, 6 Drawing Sheets

RELAXATION SOLE AND SHOE EQUIPPED THEREWITH

The present invention relates to a relaxation insole for putting inside a shoe to give the wearer of the shoe a sensation of well-being.

BACKGROUND OF THE INVENTION

The insole region of the foot is known to have numerous muscles, tendons, vessels, and nerves which, on being stimulated, can influence the rest of the organism.

OBJECTS AND SUMMARY OF THE INVENTION

The invention seeks to relax the wearer of the insole by acting on the way in which the sole region of the foot bears against the insole.

The invention achieves this by means of an insole which comprises in combination:

a supination-providing heel cup;

a heel-bone support;

a support beneath the first two metatarsals; and a support beneath the last three metatarsal heads.

The inventors have observed that such an insole provides its user with a sensation of slackening at the abdomen and in the lumbar region, a sensation of easing of the knees, and a sensation of general well-being.

The invention also provides a shoe fitted with an insole as specified above.

BRIEF DESCRIPTION OF THE DRAWINGS

Other characteristics of the invention will appear on reading the following the detailed description of an insole constituting a non-limiting embodiment of the invention, and on examining the accompanying drawings, in which.

MORE DETAILED DESCRIPTION

In the description below, reference is made to a grid for identifying the positions of the various supports formed on the insole.

Only the insole for a left foot is described, it being understood that the insole for the right foot is identical, ignoring symmetry.

The insole is subdivided lengthwise into six successive sections identified, from heel to toe by graduations 1/6 to 5/6, and widthwise into six radial stripes $R_1$ to $R_6$.

Lines $D_1$ and $D_2$ are drawn that are tangential respectively to the medial edge 1 and to the lateral edge 2 of the insole, and lines $D_3$ and $D_4$ are drawn that are tangential respectively to the back edge 3 and to the front edge 4, which lines are parallel to each other and substantially perpendicular to the longitudinal direction of the insole.

The lines between tho radial stripes $R_1$ to $R_6$ subdivide the segments of the lines $D_3$ and $D_4$ that lie between the lines $D_1$ and $D_2$ into six intervals of equal length.

The radial stripes $R_1$ to $R_6$ are numbered starting from the medial edge 1 of the insole.

Figure 1:
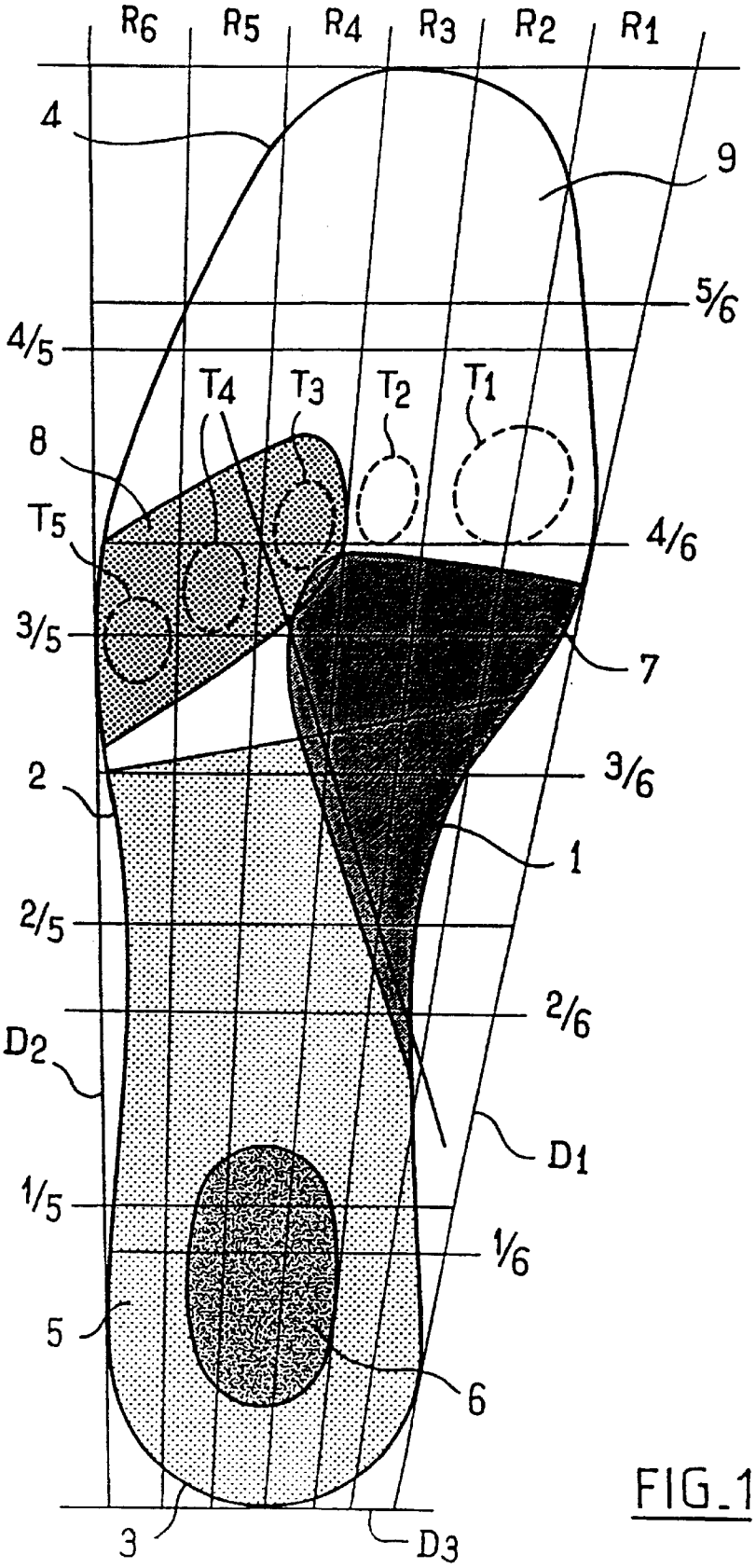
FIG. 1 is a diagrammatic plan view of an insole of the invention.

On examining FIG. 1, it will be observed that the insole has also been graduated lengthwise in fifths.

Dashed lines identify the projections $T_1$ to $T_5$ in the plane of FIG. 1 of the five metatarsal heads, which are numbered starting from the medial edge 1 of the insole.

In accordance with the invention, the insole includes;

a supination-providing heel cup 5;

a heel-bone support 6;

a support 7 beneath the first two metatarsals; and a support 8 beneath the last three metatarsal heads.

Figure 2:
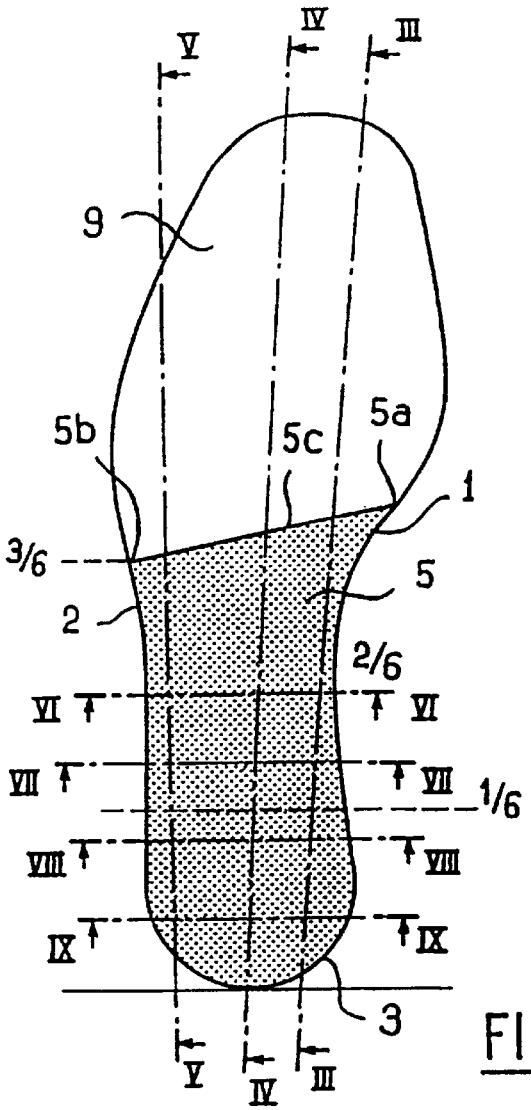
FIG. 2 is a view showing the supination-providing heel cup on its own.
Figure 6:
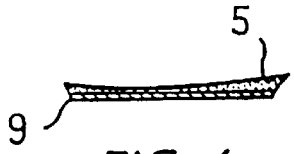
FIGS. 6 to 9 are cross-sections on section lines VI to IX respectively.
Figure 7:
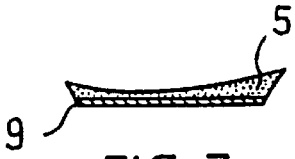
Figure 8:
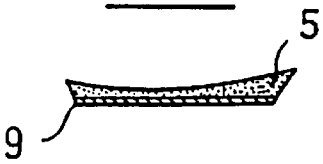
Figure 9:
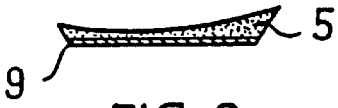
Figure 3:
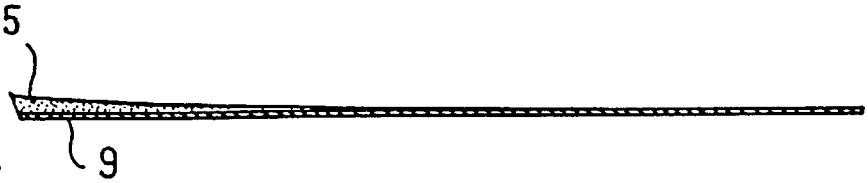
FIGS. 3 to 5 are longitudinal sections on section lines III to V respectively.
Figure 4:
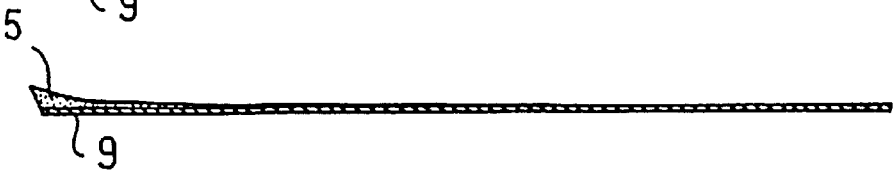
Figure 5:
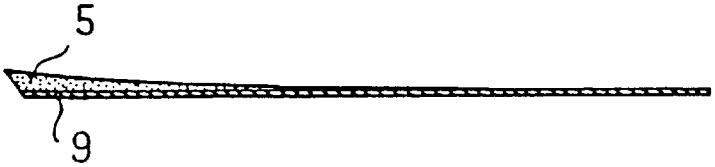

FIG. 2 is a plan view showing the outline of the supination-providing heel cup 5 on its own.

It extends longitudinally beside the medial edge 1 of the insole to a point 5*a* situated at about 11/20ths of the way along the length of the insole.

The cup 5 extends longitudinally beside the lateral edge 2 to a point 5*b* situated halfway along the length of the insole.

Between points 5*a* and 5*b*, the cup 5 is defined at its forward end by a straight line 5*c* interconnecting them.

FIGS. 3 to 9 show various sections repenting the profile of the cup 5.

On examining the sections, it will be observed that the thickness of the cup is at a maximum at its inside edge 1 between graduations 1/6 and 2/6, thereby providing support for the anterior tuberosity of the heel-bone.

The thickness of the cup 5 at its periphery decreases progressively from the zone where it is at a maximum to the point 5*a* where it is zero. The thickness remains substantially constant along the rear edge 3 and then decreases beside the lateral edge 2 from graduation 1/6, on going towards the point 5*b*, where it is zero.

On examining FIGS. 3 to 9, it will be observed that the cup 5 forms a hollow in the region beneath the heel-bone.

In the embodiment described, the thickness of the cup 5 is as follows:

5 mm at the intersection between the rear edge 3 of the insole and section plane III;

4 mm at the intersection between the rear edge 3 of the insole and section plane IV;

3 mm at the intersection between the rear edge 3 of the insole and section plane V;

5 mm at the intersection between the medial edge 1 of the insole and section plane VI;

1 mm at the intersection between the lateral edge 2 of the insole and section plane VI;

6 mm at the intersection between the medial edge 1 of the insole and section plane VII;

4 mm at the intersection between the lateral edge 2 of the insole and section plane VIII;

5 mm at the intersection between the medial edge 1 of the insole and section plane IX; and 4 mm at the intersection between the lateral edge 2 of the insole and section plane IX.

Thus, the thickness of the cup 5 as measured in a cross-section plane varies at most by about 2 mm.

The cup 5 can be made by overmolding an elastomer material or agglomerated cork on a support sheet 9 of constant thickness.

Figure 10:
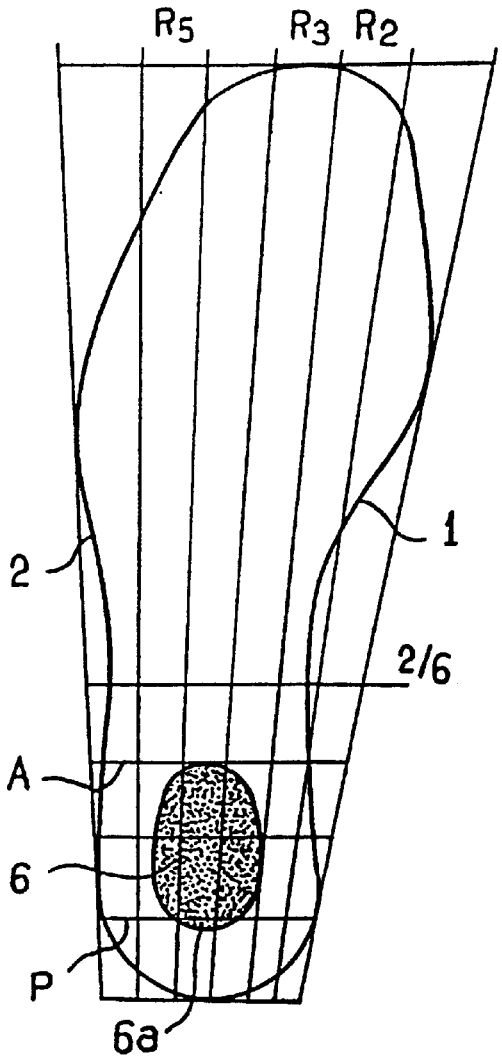
FIG. 10 shows the heel-bone support on its own.

FIG. 10 shows the heel-bone support 6 on its own.

In the embodiment described, this support 6 is made by overmolding in the hollow of the cup 5 an elastomer material which is softer than the material constituting the cup.

The top surface of the support 6 bulges outwards slightly.

The function of the support 6 is to cushion contact with the ground and to give the user a slight sensation of being propelled forwards and outwards.

In plan view, as shown in FIG. 10, the support 6 has an outline that is substantially oval and elongate in the longitudinal direction of the insole.

The posterior end 6*a* of the support 6 extends a little behind the anterior boundary P of the first posterior fourth of the posterior tarsus, and its anterior end 6*b* is situated at the posterior boundary A of the first anterior fourth of the posterior tarsus, which extends over about one-third of the length of the foot.

The support 6 extends laterally from the straight line between the second and third radial stripes $R_2$ and $R_3$, and about the middle of the fifth radial stripe $R_5$.

Thus, the support 6 is off-centered slightly towards the lateral edge 2 of the insole, in order to avoid limiting the supination-providing effect of the cup 5.

The thickness of the material constituting the support 6 is at a maximum of 5 mm in its center.

Figure 11:
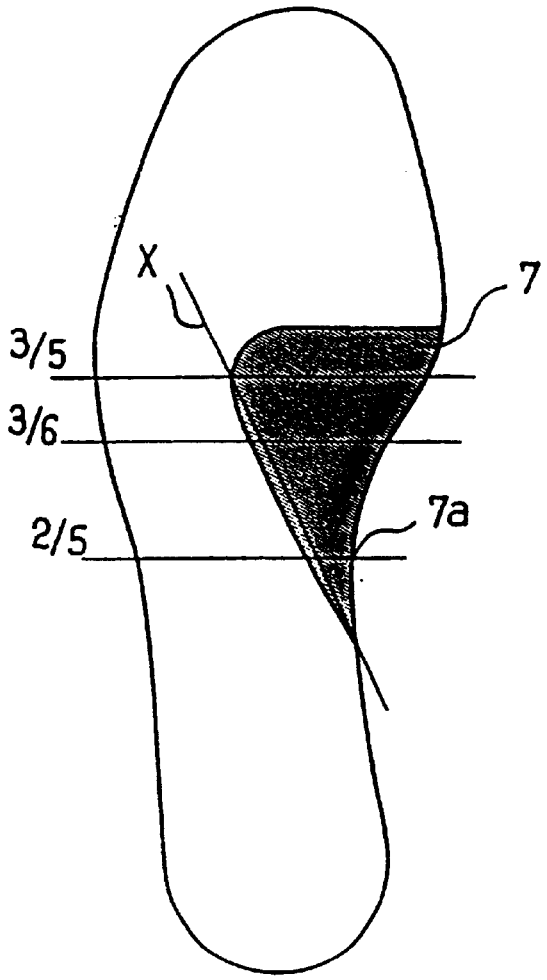
FIG. 11 shows the support for the first two metatarsals on its own.

FIG. 11 shows the support 7 on its own.

This support 7 is made by overmolding using an elastomer material that is more flexible than the material constituting the cup 5.

The support 7 extends behind the projections T1 and $T_2$ for the first two metatarsal heads and begins substantially level with the rear half of the projection $T_3$ for the third metatarsal head.

The support 7 is defined on the medial by the inside edge 1 of the insole and on its lateral it runs along a straight line X which intersects the medial edge 1 of the insole level graduation 2/6 and passes between the projections $T_3$ and $T_4$ of the third and first metatarsal heads.

The support 7 is of a height which, in general terms, decreases from the medial edge 1 of the insole towards the lateral.

The thickness of the material constituting the support 7 is at a maximum on the medial edge 1 of the insole at a point 7*a* situated at substantially two-fifths of the length of the insole.

The material constituting the support 7 is superposed on the material constituting the front end of the cup 5.

Figure 12:
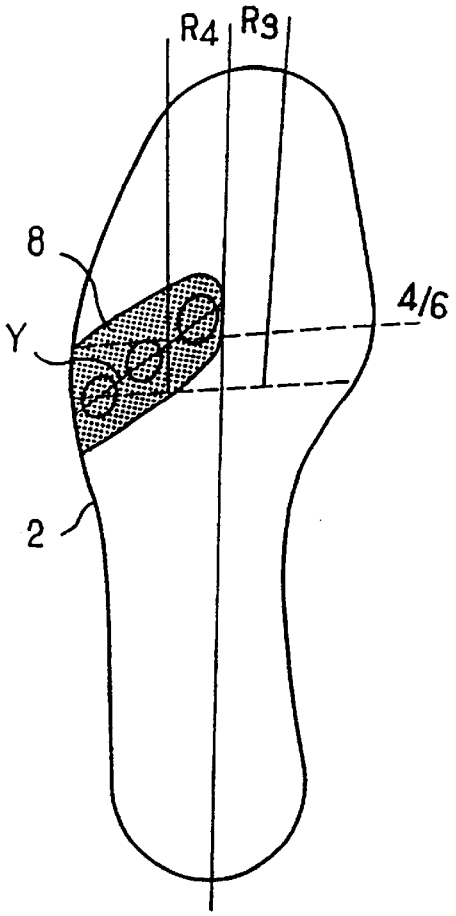
FIG. 12 shows the support for the last three metatarsal heads on its own.

FIG. 12 shows on its own the support 8 which extends laterally from the outside edge 2 of the insole to the straight line between the third and fourth radial stripes $R_3$ and $R_4$.

The support 8 extends lengthwise relative to the insole on either side of a straight line Y inter-connecting the centers of the projections $T_3$ to $T_5$ of the last three metatarsal heads, over about 15 mm forwards and about 13 mm rearwards.

The support 8 in the example described is made by overmolding using a material having the same hardness as the material used for making the cup 5.

The shape of the support 8 bulges slightly outwards.

In each section plane parallel to the longitudinal direction of the insole and perpendicular to the plane of FIG. 12, the high point of the support 8 is situated substantially on the straight line Y.

The thickness of the material constituting the support 8 is at its maximum at its intersection with the lateral edge 2 of the insole and decreases going along the straight line Y, and is equal to about 1.5 mm.

Figure 13:
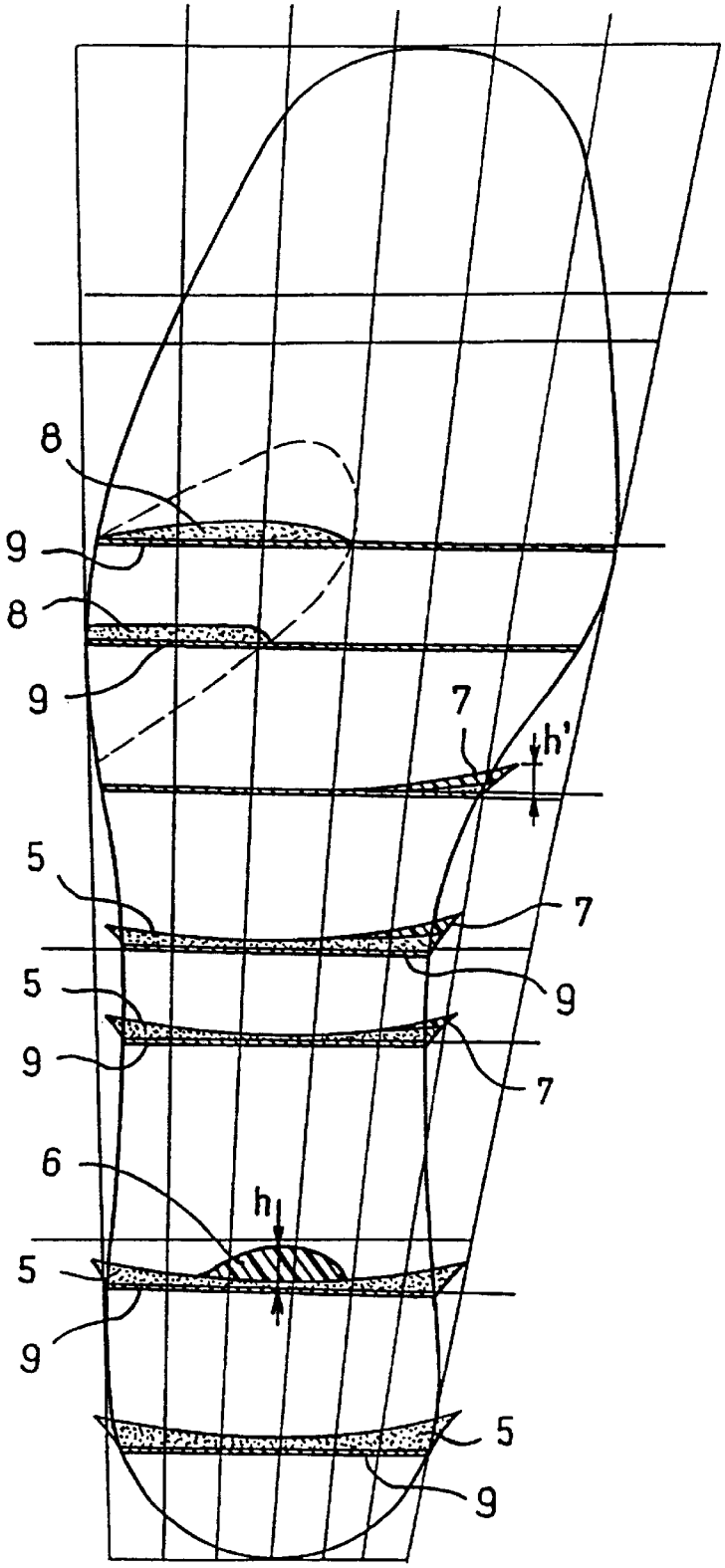
FIG. 13 shows a plurality of cross-sections of the insole.

FIG. 13 shows the profiles of the insole in successive cross-section planes. The thicknesses are sometimes exaggerated in order to clarify the drawing.

In the example described, the total thickness h of the cup 5 plus the elastomer material constituting the support 6 reaches a maximum of 7 mm, and the total thickness h' of the cup 5 plus the material constituting the support 7 reaches a maximum of 10 mm.

Figure 14:
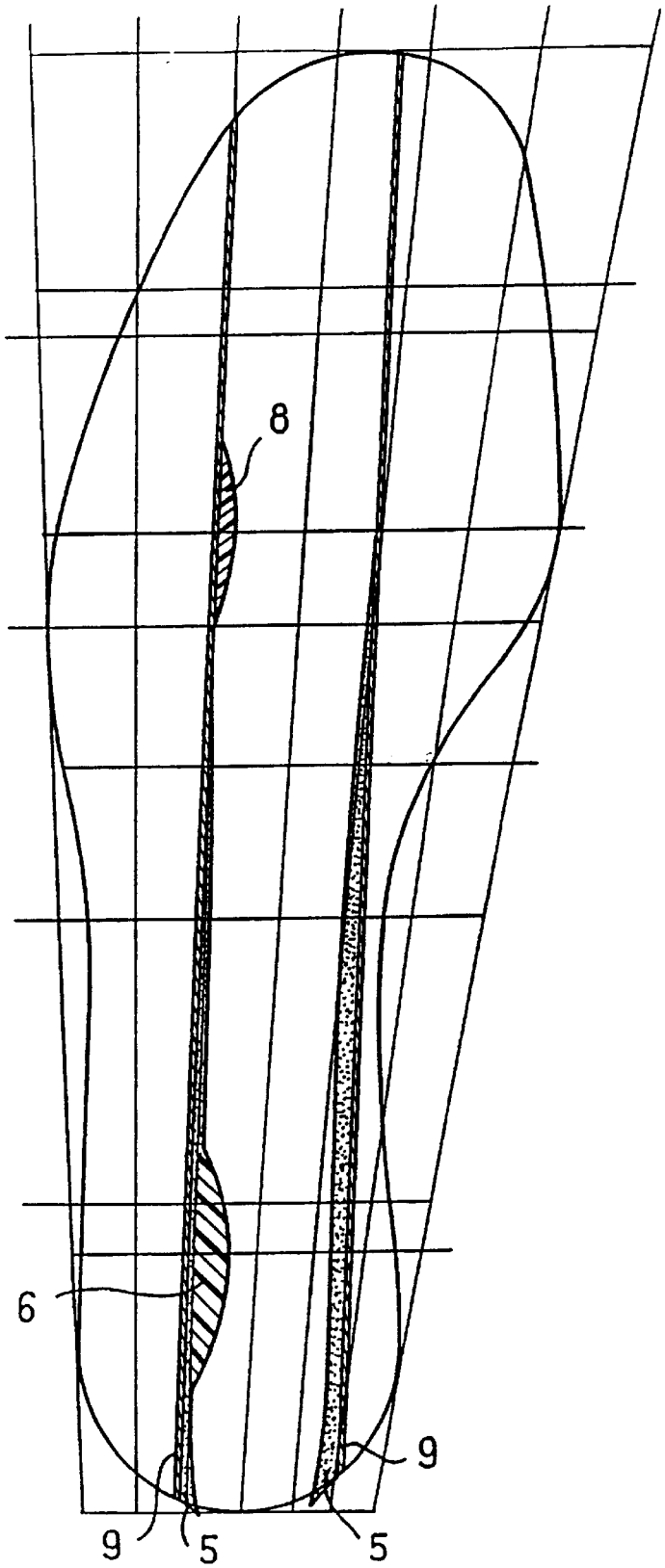
FIG. 14 shows two longitudinal sections of the insole.

FIG. 14 shows profiles of the insole in two longitudinal section planes.

Figure 15:
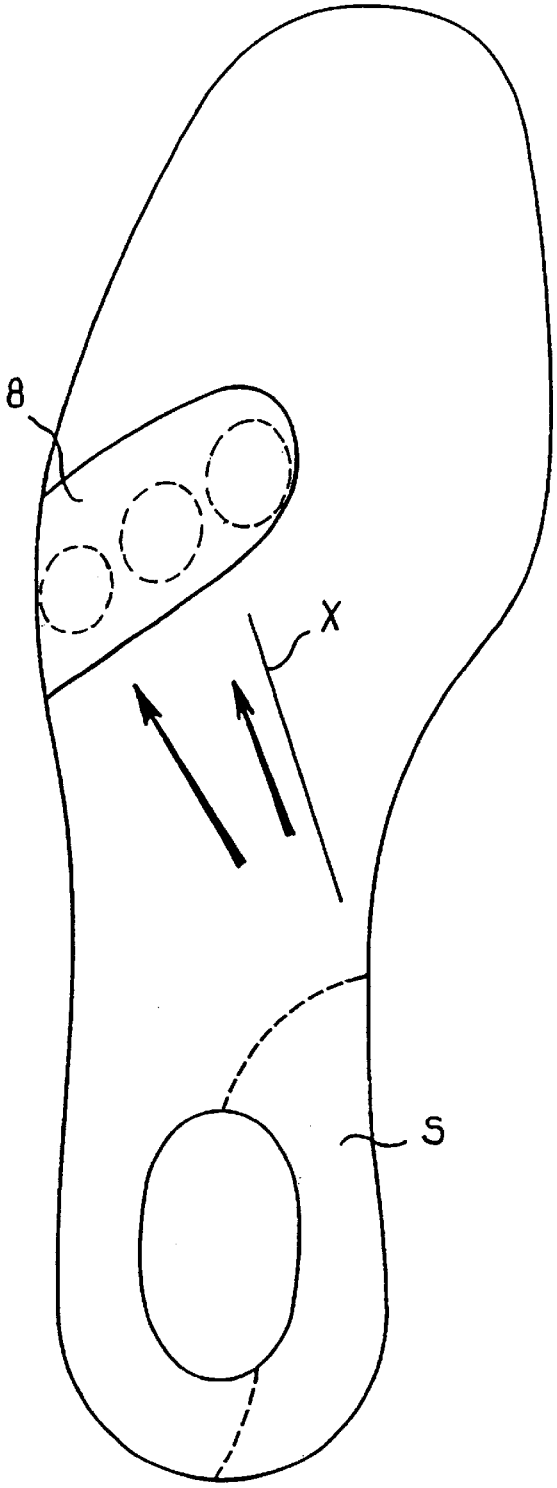
FIG. 15 shows the action of the supination-providing heel cup.

The supination-providing effect produced by the cup 5 is represented in FIG. 15 by arrows.

The medial region S of the cup 5 as outlined by dashed lines provides supporting supination to the foot, tending to tilt the foot towards the support 8 about an axis of rotation substantially perpendicular to the line X.

Naturally, it would not go beyond the ambit of the invention to make the insole by technical means other than by overmolding.

What is claimed is:

1. A relaxation insole, characterized by the fact that it comprises in combination:

a heel cup (5);

a heel-bone support (6) that is made out of a material of a hardness that is less than a hardness of a material constituting the heel cup, a support in a first two metatarsal region of the insole that is made of a material presenting hardness that is less than a hardness of the material constituting the heel cup and;

a support in a last three metatarsal head region of the insole.

2. An insole according to claim 1, wherein said cup extends longitudinally as far as a straight line joining the outside edge of the insole about halfway along its length to the inside edge of the insole at about 11/20th of its length.

3. An insole according to claim 1, wherein the height of said cup presents a maximum at the inside edge of the insole, between one-sixth and one-third of its length.

4. An insole according to claim 1, wherein the height of said cup measured in a cross-section plane varies by no more than 2 mm.

5. An insole according to claim 1, characterized by the fact that the heel-bone support (6) is slightly off-center towards a lateral edge of the insole.

6. An insole according to claim 1, characterized by the fact that the support in the first two metatarsal region of the insole extends behind the projection ($T_1$, $T_2$) of a first two metatarsal head region of the insole and begins substantially level with the rear half of the projection ($T_3$) of a third metatarsal head region of the insole, by the fact that it is defined laterally by a medial edge (1) of the insole, and by the fact that, on a lateral edge of the support in the first two metatarsal region of the insole, it extends along a straight line (X) intersecting the medial edge (1) of the insole one-third of the way along its length and passing between the projections ($T_3$, $T_4$) of a third and fourth metatarsal head regions of the insole.

7. An insole according to claim 1, characterized by the fact that the support (8) in the last three metatarsal head region of the insole extends laterally from the lateral edge (2) of the insole to an intersection between a third and a fourth radial stripe ($R_3$, $R_4$), and longitudinally on either said of a straight line (Y) interconnecting centers of projections ($T_3$, $T_4$, $T_5$) of a last three metatarsal head regions of the insole.

8. An insole according to claim 1, wherein said cup and said supports are made by overmolding on a support sheet.

9. A shoe fitted with a relaxation insole as defined in claim 1.

* * * * *